US005495728A

United States Patent [19]

Schmid et al.

[11] Patent Number: 5,495,728

[45] Date of Patent: Mar. 5, 1996

[54] ADJUSTING DEVICE FOR CAM PARTS OF FLAT KNITTING MACHINES WITH MOTOR PINION ACTING ON CONTROL SLIDERS

[75] Inventors: Franz Schmid, Bodelshausen; Martin Wörnle, Dusslingen, both of Germany

[73] Assignee: H. Stoll GmbH & Co., Reutlingen, Germany

[21] Appl. No.: 331,360

[22] Filed: Oct. 27, 1994

[30] Foreign Application Priority Data

Nov. 5, 1993 [DE] Germany ..... 43 37 775.0

[51] Int. Cl.[6] ..... D04B 15/36

[52] U.S. Cl. ..... 66/78

[58] Field of Search ..... 66/60 R, 64, 70, 66/78

[56] References Cited

U.S. PATENT DOCUMENTS

| | | | |
|---|---|---|---|
| 2,958,214 | 11/1960 | Bram | 66/78 |
| 3,304,748 | 2/1967 | Seiler | 66/64 |
| 4,502,300 | 3/1985 | Schimko et al. | 66/78 X |
| 4,686,839 | 8/1987 | Schmid | 66/75.2 |
| 4,723,423 | 9/1988 | Goller et al. | 66/78 X |
| 4,774,818 | 10/1988 | Ploppa et al. | 66/78 X |
| 5,284,032 | 2/1994 | Shima | 66/78 X |

FOREIGN PATENT DOCUMENTS

| | | | |
|---|---|---|---|
| 0215747 | 3/1987 | European Pat. Off. . | |
| 0311564 | 4/1989 | European Pat. Off. . | |
| 2622883 | 12/1976 | Germany . | |
| 3245230 | 6/1984 | Germany . | |
| 3310671 | 10/1984 | Germany . | |
| 3541171 | 5/1987 | Germany . | |
| 705388 | 5/1966 | Italy | 66/78 |
| 45343 | 9/1987 | Japan | 66/78 |
| 56174 | 11/1989 | Japan | 66/78 |
| 3185161 | 9/1991 | Japan | 66/78 |

*Primary Examiner*—John J. Calvert
*Attorney, Agent, or Firm*—Michael J. Striker

[57] ABSTRACT

In an adjusting device for opposite adjustment of drawing off cam parts of a cam system of a flat knitting machine carriage, with a common stepper motor moving with the machine carriage and providing a rotary movement which is converted into a longitudinal movement of a carriage running direction and transferred to cam parts to be adjusted, with at least one control curve transferring the rotary movement of the stepper motor the cam parts to be adjusted, and with two first control sliders adjustable in the carriage running direction and provided with a toothed strip, a driven pinion of the stepper motor acts simultaneously and oppositely directly on the first control sliders, and at least two second control are each connected with a cam part to be adjusted, with which the first control sliders are drivingly coupled through the control curve in a drawing manner.

8 Claims, 2 Drawing Sheets

ADJUSTING DEVICE FOR CAM PARTS OF FLAT KNITTING MACHINES WITH MOTOR PINION ACTING ON CONTROL SLIDERS

BACKGROUND OF THE INVENTION

The present invention relates to an adjusting device for cam parts of flat knitting machines.

Particularly, it relates to a device for opposite adjustment of both drawing off cam parts of a cam system of the machine carriage, with a common stepper motor movable with the machine carriage and providing a rotary movement which is converted into a longitudinal movement of the carriage stroke direction and transferred through at least one control curve to the adjusting cam parts.

The reciprocating working movement of the machine carriage of a flat knitting machine requires substantially symmetrical construction of the individual cam systems from cam parts, which are operative both in one carriage stroke direction and in another carriage stroke direction. Therefore, also a part of the cam parts must be adjustable during the operation of the flat knitting machine. For predetermined cam parts operating in pairs, especially the drawing off cam parts, therefore an opposite adjustment of both individual cam parts must be possible.

It is possible to associate a separate drive element with individual cam parts to be adjusted, for example, a switching magnet or a stepper motor. This requires a correspondingly high control expense with a corresponding increase in the occurrence of errors. It is also known to adjust the oppositely movable cam parts simultaneously by means of a common drive element. For this purpose for example a stepper motor acts on a single slider provided with a control curve which acts on both cam parts, as disclosed for example in the patent documents DE 35 41 171 A, EP 311 564 A, DE 26 22 883 A. It has been determined that it is disadvantageous that due to this common control slider, the adjustment path of both cam parts is determined by their common possible adjustment region and when needed no additional individual adjustment of both cam parts is possible.

SUMMARY OF THE INVENTION

Accordingly, it is an object of the present invention to provide an adjusting device for cam parts of flat knitting machines, which has a common adjusting motor for several cam parts and is formed so that within a predetermined common adjusting region, in addition to individual adjusting steps also a common adjustment in individual predetermined stages can be provided.

In keeping with these objects and with others which will become apparent hereinafter, one feature of the present invention resides, briefly stated, in an adjusting device for cam parts of a flat knitting machine, in particular for opposite adjustment of both pulling off cam parts of a cam system of a machine carriage, with a common stepper motor moving with the machine carriage and providing a rotary movement which is converted in a longitudinal movement in a carriage running direction, and transferred through at least one control curve to cam parts to be adjusted, wherein in accordance with the present invention, a driven pinion of the stepper motor acts simultaneously and in opposite directions directly on two first control sliders provided with a toothed strip and adjustable in the carriage running direction, which first control sliders are drivingly coupled in a drawing manner with at least two second sliders and correspondingly connected with a cam part to be adjusted, through a control curve.

By subdividing a known individual control slider into several separate and at least partially oppositely adjustable first control sliders which act on second control sliders with which the cam parts to be adjusted are coupled, it is possible to provide a stepped individual movement of cam parts coupled with one another in a driving manner, when several first control sliders can act on the second control sliders. This possibility can be advantageous for different cam parts of the machine carriage of a flat knitting machine since with such an adjusting device complicated adjusting movements of cam parts can be performed by means of a single drive element, in particular a stepper motor, and correspondingly lower individual control expenses take place. In an especially advantageous manner such an adjusting device operates for the required opposite adjustment of both pulling off cam parts of a cam system of a flat knitting machine, where this opposite adjusting movement is subdividable into steps.

Advantageously, at least one both first control sliders driven directly from the stepper motor can be coupled in a driving manner with at least one further first control driver which is adjustable parallel to both other control drivers, through at least one coupling toothed pinion. The first control sliders can selectively carry at least one coulisse roller or can be provided with at least one guiding path for a coulisse roller, while the second sliders are provided with at least two control curves which are formed at an opposite distance from two first sliders and have control portions which deviate from the carriage running direction.

In an adjusting device in accordance with the present invention provided for controlling two displaceably supported drawing off cam parts of a cam system which are mirror-symmetrically inclined to the carriage direction, the both second sliders carrying the drawing off cam parts at a distance from two oppositely driven first sliders can each be provided with two transversely extending control curves. These curves are open at both ends for running in and running out of a coulisse roller and each have an angling to form two running off inclined surfaces which are completely offset relative to one another in the carriage running direction for guiding the coulisse rollers. It is therefore guaranteed that always only one of the first control sliders acts on the second control sliders, but as a whole within a possible total adjustment path several first control sliders can influence the second control slider.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
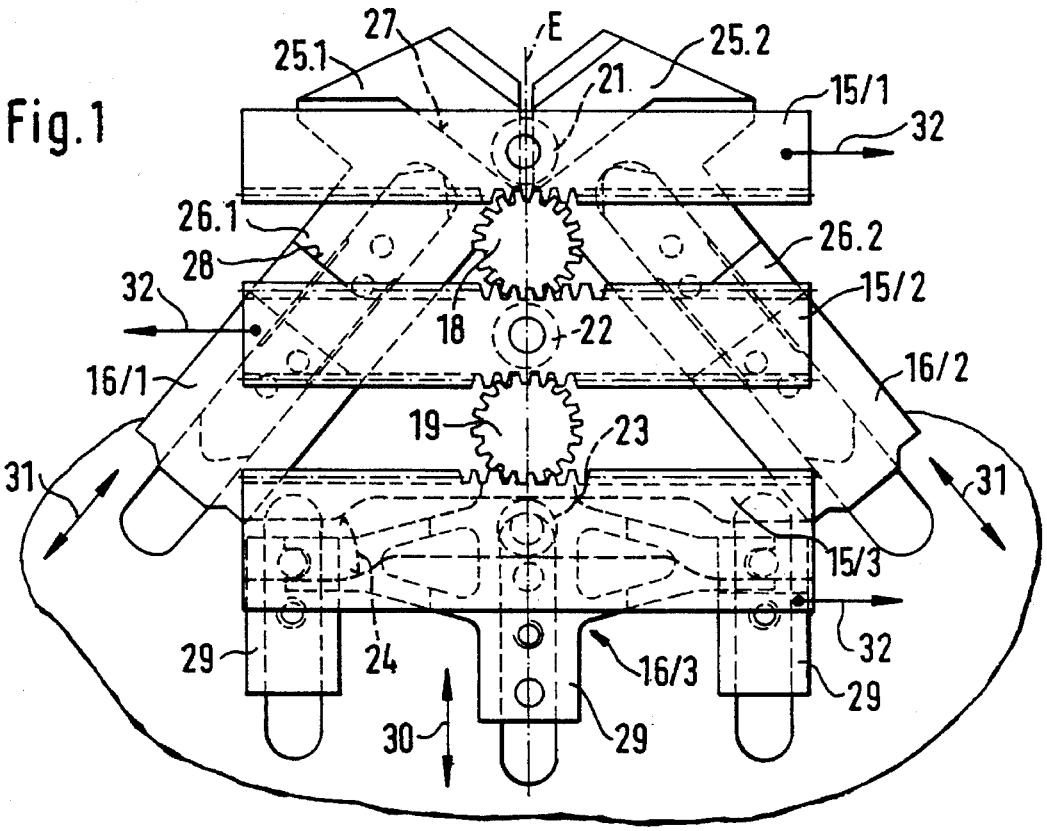
FIGS. 1–3 are views schematically showing cooperating first and second control sliders of an adjusting device in accordance with the present invention, as seen in plane I—I in FIG. 4 in three different relative positions of the control slider.

An adjusting device with its parts which constitutes the subject matter of the present invention is shown in the drawings. The adjusting device has a housing 10 which can be seen in FIG. 4. The housing 10 is arranged in a not shown manner on a rear side 11.1 of a cam plate 11 which on its front side 11.2 carries cam parts in a known manner. Drawing off cam parts 12 to be adjusted and pushing cam parts 13 to be adjusted are the cam parts in question. The cam parts 12, 13 to be adjusted are connected through guiding slots, for example 14 of the cam plate 11 with second control sliders arranged on the rear side 11.1 of the cam plate 11. The second control sliders are identified as 16/2 and 16/3 in FIG. 4.

Three first control sliders 15/1, 15/2, 15/3 are arranged parallel to one another in the housing 10 of the adjusting device and displace in a carriage running direction. Their longitudinal sides are formed as toothed strips 17 shown in FIGS. 1–3. Pinions 18 and 19 immovably supported in the housing engage in the toothed strip and actuate a coupling of neighboring first control sliders 15/1–15/3 at opposite sides and in opposite directions. The pinion 19 is arranged on a driven shaft of a stepper motor 20 mounted on the housing 10, as shown in the diagram of FIG. 4. It can be also seen from FIG. 4 that both first control sliders 15/1 and 15/2 carry a spherical coulisse roller 21 or 22 which extend in control curves of the second control sliders, while the first control slider 15/3 is provided with a control curve 24 in which a coulisse roller 23 arranged on the second control slider 16/3 engages.

Figure 2:
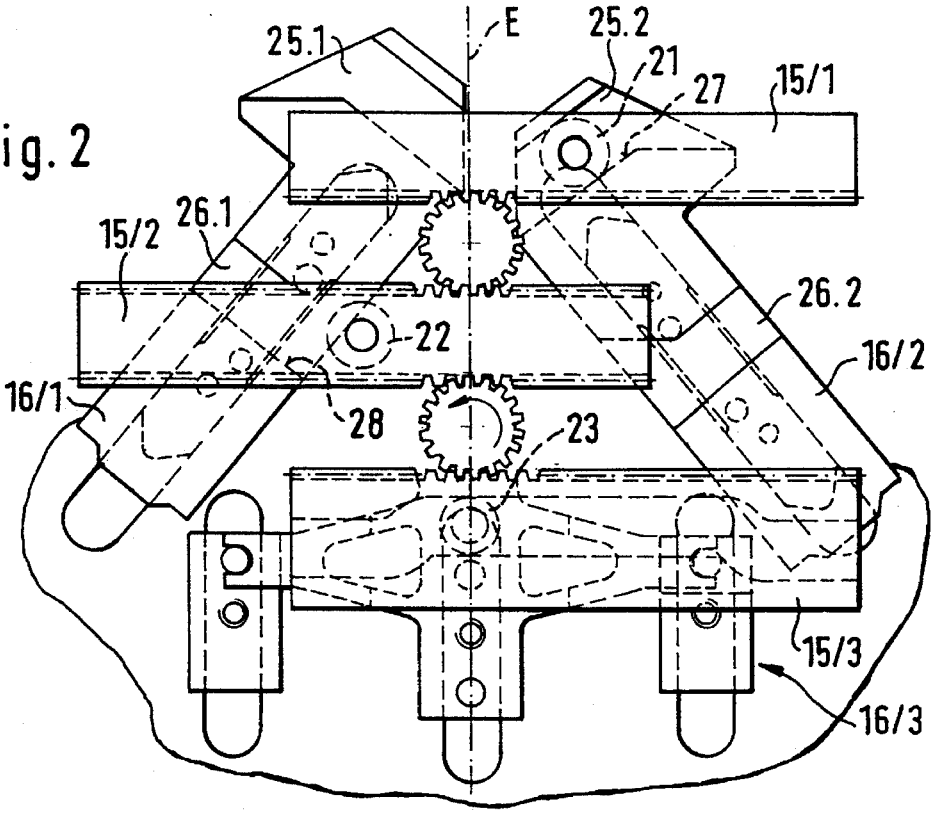
Figure 3:
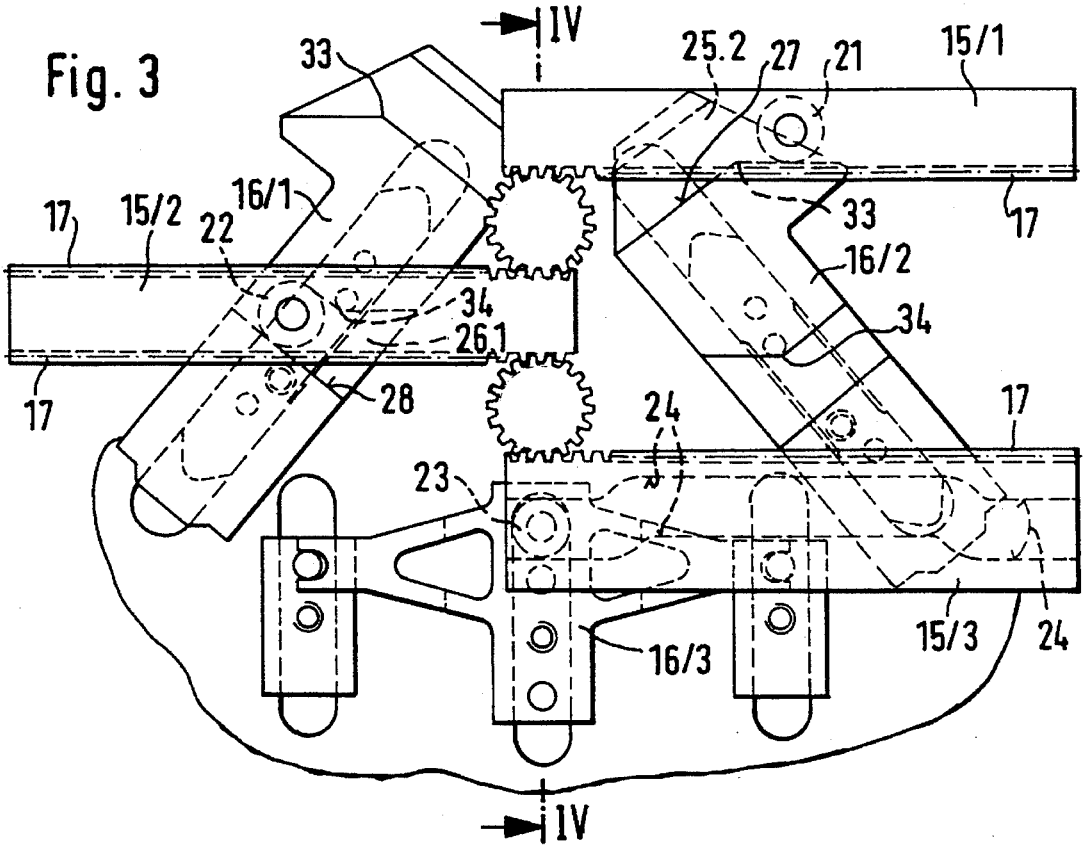
Figure 4:
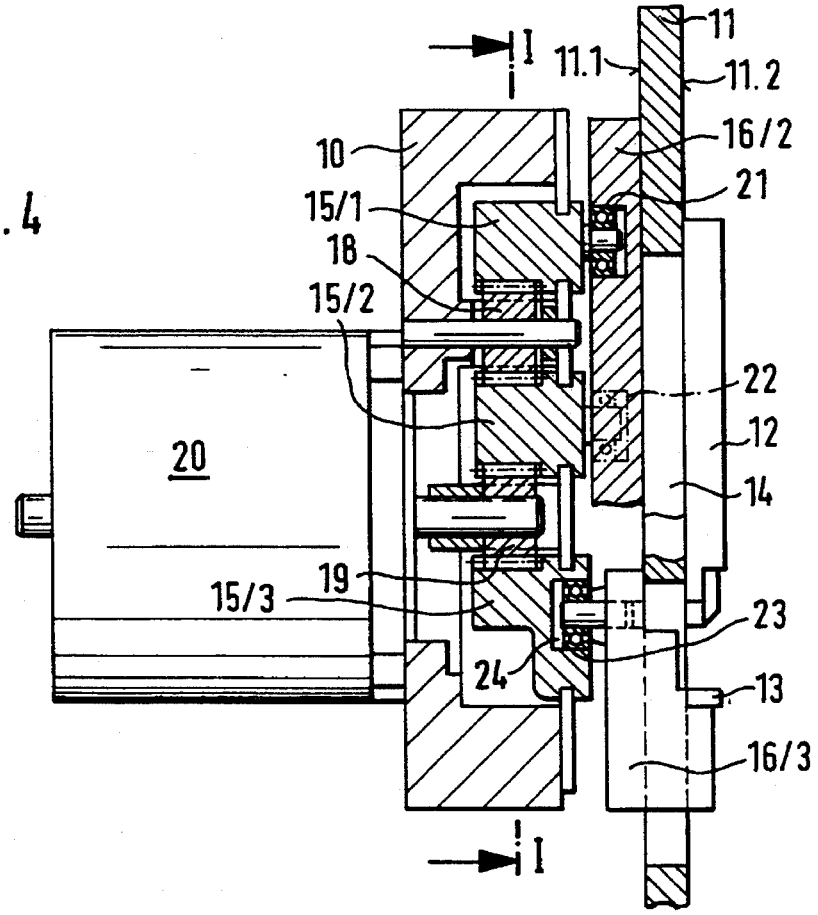
FIG. 4 is a view showing a cross-section of the adjusting device taken along the line IV—IV in FIG. 3.

FIGS. 1–3 show the cooperation of the first and the second control sliders of the device. The second control sliders which are mirror-symmetrically inclined relative to the carriage running direction and each carry a drawing off cam part 12 of FIG. 4, are shown in FIG. 1 at the same height adjustment and therefore comb-uniform. In this position all three first control sliders 15/1, 15/2, 15/3 oriented in the carriage running direction assume a symmetrical central position. All three coulisse rollers 21, 22 are located in the plane of symmetry of the cam system identified with a dash-dot line, in which also the axes of both coupling and drive pinion 18, 19 are located. Both the control sliders 16/1 and 16/2 which are mirror-symmetrically identical and carry the drawing off cam parts 12 are provided at a distance from both coulisse rollers 21, 22 and 23 of the first control sliders 15/1 and 15/2, with two control paths 25.1 and 26.1 or 25.2 and 26.2. The control paths extend transversely and are open at both sides of the second control sliders 16/1 and 16/2. They are designed non-uniformly and each provided with a fault 33, 34. Both control paths form running-on surfaces 27 and 28 which are inclined relative to the carriage running direction and thereby the adjusting direction of the first control sliders 15/1 and 15/2. Both inclined running-on surfaces 27 and 28 do not overlap as seen in the carriage running direction. This means that with the mirror-symmetrical arrangement of both second control sliders 16/1 and 16/2, the coulisse roller 21 of the first control slider 15/1 runs on the inclined surface 27 of one of the both second control sliders 16/1 or 16/2, while the coulisse roller 22 of the first control slider 15/2 does not run on the inclined running surface 28 of the other second control slider.

The control curve 24 formed in the first control slider 15/3 for the coulisse roller 23 of the second control slider 16/3 is shown in FIG. 1 although covered, with a thick broken line so as to illustrate its symmetrical construction. It controls through the coulisse roller 23 the second control slider 16/3 which ends in three tongues 29 each carrying a pushing cam part 13 as shown in FIG. 1, in direction of the double arrow 30 identified in FIG. 4. The inclined adjusting movement of both other second control sliders 16/1 and 16/2 is identified by the double arrow 31, while the opposite longitudinal movement of the first control sliders 15/1–15/3 is shown in FIG. 1 by the arrow 32.

When in the symmetrical position of the adjusting device shown in FIG. 1 the shaft of the stepper motor 20 and thereby the pinion 19 is moved in counterclockwise direction, the opposite adjustment of the first control sliders 15/1–15/3 shown in FIG. 2 is performed. The coulisse roller 21 of the first control slider 15/1 runs on the inclined running-on surface 27 of the control path 25.2 of the second control slider 16/2 and an inclined downward movement of the second control slider actuates a desired pulling off of the associated pulling off cam part 12. The other second control slider 16/1 which carries a pulling off cam part 12 remains in the comb-identical position, while the coulisse roller 22 of the oppositely moving first control slider 15/2 does not reach the inclined running-on surface 28 of the control path 26.1 of the first control slider 16/1. A second control slider 16/3 with the pushing cam part 13 also has no adjusting movement since its coulisse roller 23 is located in the rectilinear central part of the control path of the first control slider 15/3.

When a further adjusting movement of the stepper motor 20 is performed in a counterclockwise direction of its driven shaft, the adjusting device assumes a relative position of its control sliders shown in FIG. 3. The second control slider 15/2 moves in the deepest pulling out position of its pulling cam part 12 downwardly. The coulisse roller 21 leaves the running on incline 27 and is located on a portion of the control path 25.2 which is directed to the carriage adjusting direction. The coulisse rollers 22 of the first control slider 15/2 runs on the incline 28 of the control path 26.1 of the other second control slider 16/1 and thereby displaces also the other pulling off cam part 12 of the control system in the pulling out direction from the comb identical position in the texture. The coulisse roller 23 of the second control slider 16/3 runs in the end portion of the control path 24 of the first control slider 15/3 and actuates an adjusting movement of the second control slider 16/3 provided with the pushing cam parts 13 in direction of the arrow 30 in FIG. 1 and thereby transverse to the carriage running direction.

With a reverse of the rotary direction of the stepper motor 20, first a reverse adjustment of the control slider in the comb-uniform position of FIG. 1 is performed, and then the adjustment of the second control slider 16/1 in a desired pulling off position of its pulling off cam part 12 is performed.

The adjusting device can have more than three first sliders 15 coupled with one common adjusting motor, wherein individual first control sliders can act directly and without an intermediate switching of second control sliders on a cam part or several cam parts. Also, the :single control slider can be provided with more than one control path or more than one coulisse roller.

It will be understood that each of the elements described above, or two or more together, may also find a useful application in other types of constructions differing from the types described above.

While the invention has been illustrated and described as embodied in an adjusting device for cam parts of flat knitting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An adjusting device for opposite adjustment of both drawing off cam parts of a cam system of a flat knitting machine carriage, the adjusting device comprising a common stepper motor moving with the machine carriage and providing a rotary movement; means for converting said rotary movement into a longitudinal movement of a carriage running direction and cam parts to be adjusted; at least one control curve through which the rotary movement of said stepper motor is transferred to the cam parts to be adjusted, said stepper motor being provided with a driven pinion; two first control sliders adjustable in the carriage running direction and provided with a toothed strip, said driven pinion acting simultaneously and oppositely directly on said first control sliders; and at least two second control sliders each connected with a cam part to be adjusted, with which said first control sliders are drivingly coupled through said control curve in a drawing manner.

2. An adjusting device as defined in claim 1, wherein at least one of said first control sliders is coupled with at least one further first control slider which is adjustable parallel to said first mentioned first control sliders.

3. An adjusting device as defined in claim 2; and further comprising at least one coupling toothed pinion through which said at least one first control slider is coupled with said at least one further control slider.

4. An adjusting device as defined in claim 1, wherein at least one of said first control sliders carries at least one coulisse roller which cooperates with said control curve of one of said second control sliders, at least in a drawing manner.

5. An adjusting device as defined in claim 1, wherein at least one of said first control sliders is provided with at least one guiding path; and further comprising a coulisse roller arranged on one of said second control sliders and guided in said at least one guide path.

6. An adjusting device as defined in claim 1, wherein at least one of said first control sliders is provided with at least one guiding path; and further comprising a coulisse roller arranged on one of said second control sliders and guided on said at least one guide path.

7. An adjusting device as defined in claim 1, wherein said second control slider is provided with at least two said control curves which are formed at opposite distances from said two first control sliders and have curved portions extending from said carriage running direction.

8. An adjusting device as defined in claim 1, wherein said second control sliders are arranged mirror-symmetrically inclinedly to said carriage running direction and each carry one of both drawing off cam parts of a cam system, said second control sliders being provided with two said control curves extending at a distance from said two first control sliders driven in opposite directions, said control curves being open at both ends for running in and for running out of a coulisse roller and form two running-on inclined surfaces for the coulisse rollers which are offset relative to one another in said carriage running direction.

* * * * *